US005971822A

United States Patent [19]

Ohta et al.

[11] Patent Number: 5,971,822

[45] Date of Patent: Oct. 26, 1999

[54] AIR INTAKE SYSTEM FOR OUTBOARD MOTOR

[75] Inventors: Mitsuhiko Ohta; Yoshiaki Yuda; Atsushi Noda, all of Shizuoka-ken, Japan

[73] Assignee: Suzuki Motor Corporation, Japan

[21] Appl. No.: 09/001,632

[22] Filed: Dec. 31, 1997

[30] Foreign Application Priority Data

Jan. 31, 1997 [JP] Japan ..... 9-019458

[51] Int. Cl.[6] ..... B63H 21/38

[52] U.S. Cl. ..... 440/88; 123/184.23; 123/184.42

[58] Field of Search ..... 440/88; 123/184.21, 123/184.23, 184.24, 184.42

[56] References Cited

U.S. PATENT DOCUMENTS

| | | | |
|---|---|---|---|
| 5,554,060 | 9/1996 | Koishikawa et al. | 440/88 |
| 5,683,277 | 11/1997 | Tsunoda et al. | 440/88 |
| 5,823,835 | 10/1998 | Takahashi et al. | 440/88 |
| 5,832,890 | 11/1998 | Ikeya et al. | 123/184.34 |

FOREIGN PATENT DOCUMENTS

| | | |
|---|---|---|
| 5-60024 | 3/1993 | Japan . |
| 6-129315 | 5/1994 | Japan . |
| 6-129316 | 5/1994 | Japan . |

OTHER PUBLICATIONS

Translation of English Language Abstract of 6–129315.

Translation of English Language Abstract of 5–60024.

*Primary Examiner*—Sherman Basinger

*Attorney, Agent, or Firm*—Finnegan, Henderson, Farabow, Garrett & Dunner

[57] ABSTRACT

An outboard motor air intake device having a throttle body is located essentially horizontally in front of the engine, and includes a surge tank located on a side part of the throttle body, and an air intake manifold with multiple air intake pipes which extend on one side of the engine from the surge tank to each of the cylinders. A throttle valve is located in the throttle body and the linkage mechanism that operates this throttle valve is located opposite to the engine's air intake manifold, so that the linkage is easy to assemble and maintain.

5 Claims, 6 Drawing Sheets

AIR INTAKE SYSTEM FOR OUTBOARD MOTOR

BACKGROUND OF THE INVENTION

The present invention concerns air intake devices used with outboard motors.

DESCRIPTION OF RELATED ART

FIGS. 5 and 6 show a right side view of the air intake components commonly used in an outboard motor of conventional design. As shown in the figures, the principal components of the outboard motor engine are a crank case (1), a cylinder block (2), and a cylinder head (3). These components are generally positioned vertically, one above the other. Additionally, outboard motors have electric instruments (6) and an air intake device located near the intake device.

The air intake device (7) for the outboard motor that is shown in the figures comprises a surge tank (9), and an air intake manifold (11) outfitted with air intake pipes (10) that extend to each of the cylinder intake valves. A throttle body (8) is located in the front area of the engine (5), and a surge tank (9) is located on a side portion of the engine (5). The air intake pipes (10) are also located on a side portion of the engine (5), and extend from the surge tank (9) to the air intake ports (12) formed in the cylinder head (3).

The linkage mechanism (14) that operates the throttle valve (13) in the throttle body can be located in the lower part of the air intake manifold (11), as shown, for example, in Japanese Laid Open Patent Application Hei 6 (1994)-129315.

The interface (15) connecting the surge tank (9) to the air intake pipes (10) can be vertical, as shown, for example, in Japanese Laid Open Patent Application Hei 5 (1993)-60024. The air intake pipes (10) are made by bending straight pipes by different amounts, so that straight pipes of equal length can be used to form all the air intake pipes (10).

However, the conventional designs leave limited space in the lower part of the air intake manifold, which makes it difficult to provide a link mechanism for the throttle valve that is easy to assemble and to maintain.

When the interface between the surge tank and the intake pipes is vertical, the air intake pipes must be bent in complex shapes to be able to use air intake pipes of equal length before bending. This requires casting molds that are complex and costly. Also, because the air intake tubes are bent in a complex way, they offer excessive resistance to the flow of air and to the engine and do not allow a smooth flow of air.

SUMMARY OF THE INVENTION

Accordingly, the present invention was made to resolve the problems discussed above. One objective of the invention is therefore to provide an outboard motor air intake device that has a linkage mechanism activating the throttle valve that is easy to assemble and to maintain.

Another objective of the present invention is to provide an outboard motor air intake device that is compact and that improves the distribution of air to the engine.

Yet another objective of the present invention is to provide an outboard motor air intake device having a compact external configuration, while maintaining a large space between the air intake tubes and the engine.

A further objective of the present invention is to provide an outboard motor air intake device which requires air intake pipes that can be cast using less expensive molds.

Yet another objective of the present invention is to provide an outboard motor air intake device having air intake pipes that allow a smoother flow of air to reach the engine.

To achieve these and other advantages and in accordance with the purpose of the invention, as embodied and broadly described, the invention is an outboard motor air intake device having a throttle body located generally horizontally in front of the engine, a surge tank arranged on a side of the throttle body, and an air intake manifold with multiple air intake pipes that are located on one side of the engine and extending from the surge tank to each of the cylinders. The outboard motor air intake device also has a throttle valve located in the throttle body, and the linkage mechanism that operates this throttle valve is located on a side of the engine opposite from the air intake manifold.

A ring gear operationally connected to a starter motor is located in the upper part of the engine, and the air intake device is located beneath this ring gear. The air intake pipes are arranged vertically in a stack, one above another, on one side of the engine. The throttle body is disposed between the midpoints of the uppermost and lowermost air intake pipes.

The rear surface of the surge tank to which the above-mentioned air intake pipes are joined is formed on a rearward facing oblique plane. The bottom end of the rear surface is located further towards the back of the engine than to the top end.

The air intake pipes of the air intake manifold are located further away from the engine block the further down they connect with the surge tank. The surge tank has a width that gradually increases from top end to bottom so that the air intake pipes near the bottom of the surge tank can be secured further from the engine block.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of the specification, illustrate several embodiments of the invention, and together with the description serve to explain the principles of the invention. In the drawings.

DETAILED DESCRIPTION OF A PREFERRED EMBODIMENT

Reference will now be made in detail to the present preferred embodiments of the invention, examples of which are described in the accompanying specification and illustrated in the accompanying drawings.

While the present invention can be broadly applied in the field of outboard motors, it is especially well suited for use in an outboard motor having a fuel injection system.

Figure 1:
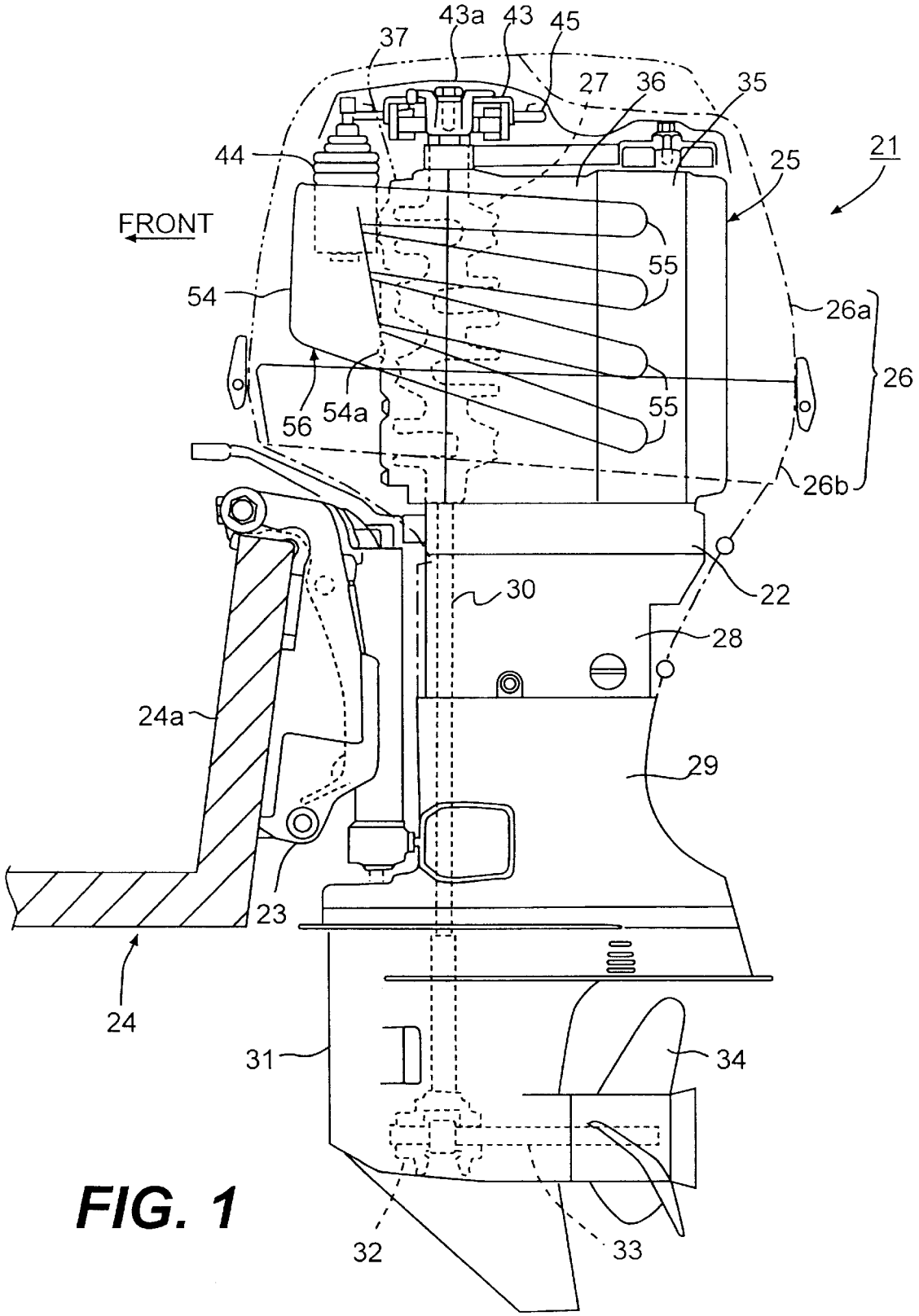
FIG. 1 is a left side view showing an embodiment of the present invention used in an outboard motor air intake device.
Figure 2:
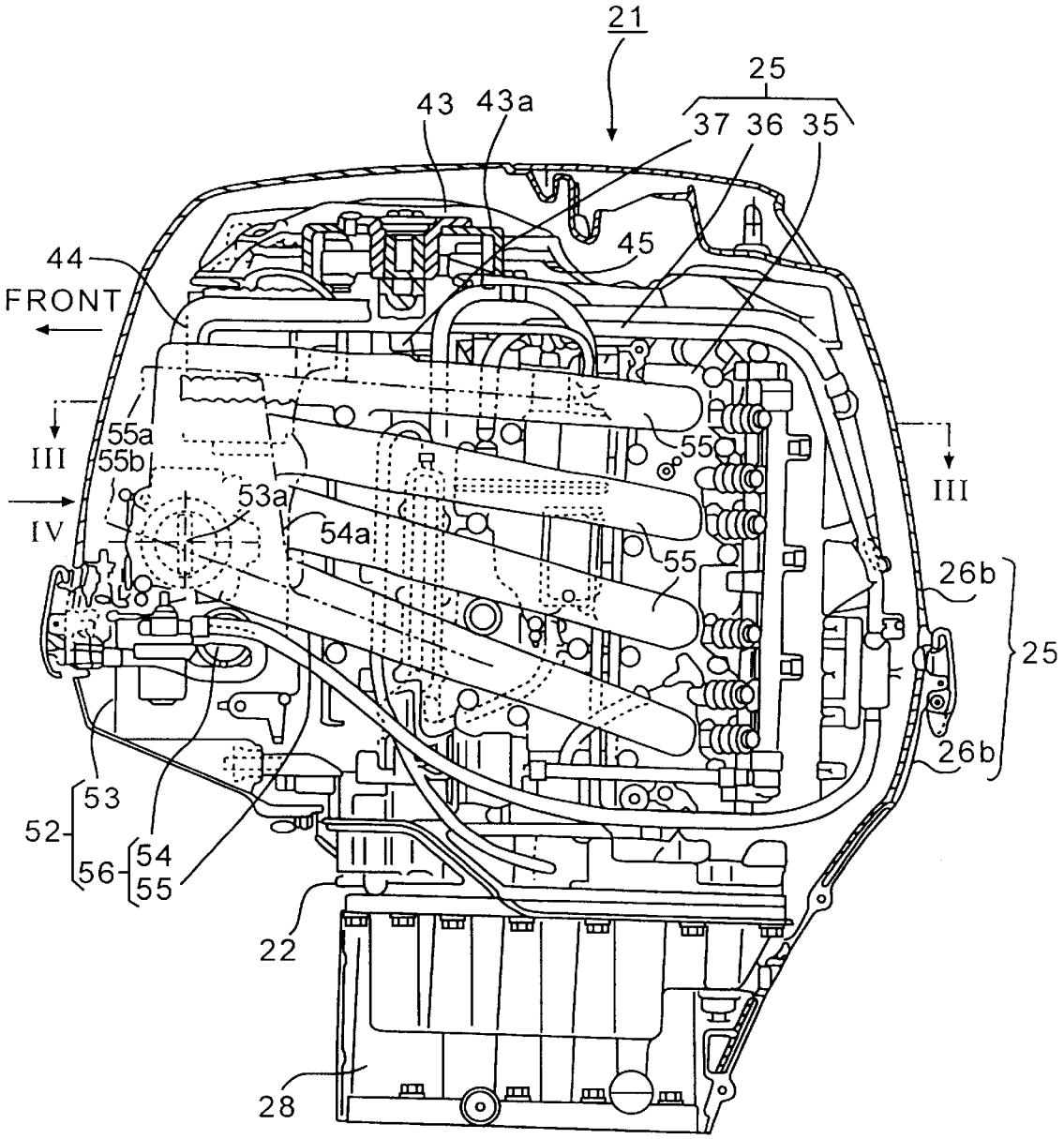
FIG. 2 is a left side view of an enlargement of the engine part shown in FIG. 1.

FIG. 1 is a left side view of an outboard motor in which the present invention is utilized. The outboard motor (21) is provided with an engine holder (22). The holder (22) is mounted on a transom (24*a*) of boat (24) by means of a bracket (23) attached to the engine holder (22).

An engine (25) is located above the engine holder (22). The engine and the surrounding components are covered with an engine cover (26). The engine cover (26) can be separated into top and bottom parts to provide an upper cover (26*a*) and a lower cover (26*b*). In addition, the lower cover (26*b*) can be separated into right and left portions. Lower cover (26*b*) protects the lower part of the engine (25) and the area surrounding engine holder (22), while the upper part of the engine (25) is covered by upper cover (26*a*).

A crank shaft (27) is oriented vertically within the engine (25), so that it is generally at a right angle to the hull of the boat. Drive shaft housing (29) shields the oil pan (28), and is located below engine holder (22). A drive shaft (30) extends downward through the oil pan (28) and the drive shaft housing (29). The drive shaft is connected to the bottom end of the crank shaft (27). A propeller (34) is driven by a propeller shaft (33) located in the bottom part of the drive shaft housing (29), and connected to drive shaft (30) by bevel gear (32).

As shown in FIGS. 1–4, engine (25) can be a water-cooled, four-cycle, four cylinder engine, for example, having a cylinder head (35), a cylinder block (36), and a crank case (37).

A cylinder (38) is formed in the engine cylinder block (36). A combustion chamber (39) complementing cylinder (38) is formed in the cylinder head (35). A spark plug penetrates the combustion chamber (39), and extends outward from the cylinder head. A piston (41) is inserted vertically into the cylinder, and is able to reciprocate freely. The piston (41) and the crank shaft (27) are joined by a connecting rod so that the power stroke of the piston (41) is converted into rotational motion of the crank shaft (27).

A flywheel magnet device (43) used to generate electricity is located on the top end of the crank shaft (27). A ring gear (45) is located on the exterior perimeter of the flywheel, and is operationally connected to a nearby starter motor (64).

An exhaust port (44) and an air intake port (46) are formed in the cylinder head (35), and are connected to the combustion chamber (39). An air intake valve (48) and an exhaust valve (49), that open and close respectively ports (46) and (44), are located in the cylinder head. Valve opening devices (50) that open and close valves (48, 49) are provided.

An electrical device (51) and an air intake device (52) are located adjacent to the engine. The air intake device includes a throttle body, a surge tank, and an air intake manifold outfitted with multiple air intake pipes (55) extending from the surge tank (54) to a respective cylinder. Air intake device (52) is located below ring gear (45). The throttle body (53) is located in front of the engine crank case (37), and extends essentially horizontally, in a direction orthogonal to the length of the crank shaft (27). In this embodiment, an elongated vertical surge tank (54) is provided on the port side (the left side relative to the boat's direction of forward motion) of the throttle body (53). The air intake pipes (55) are stacked top to bottom, one above another, also on the port side. The cylinder head's air intake ports (46) communicate with the interior of tank 54.

Figure 3:
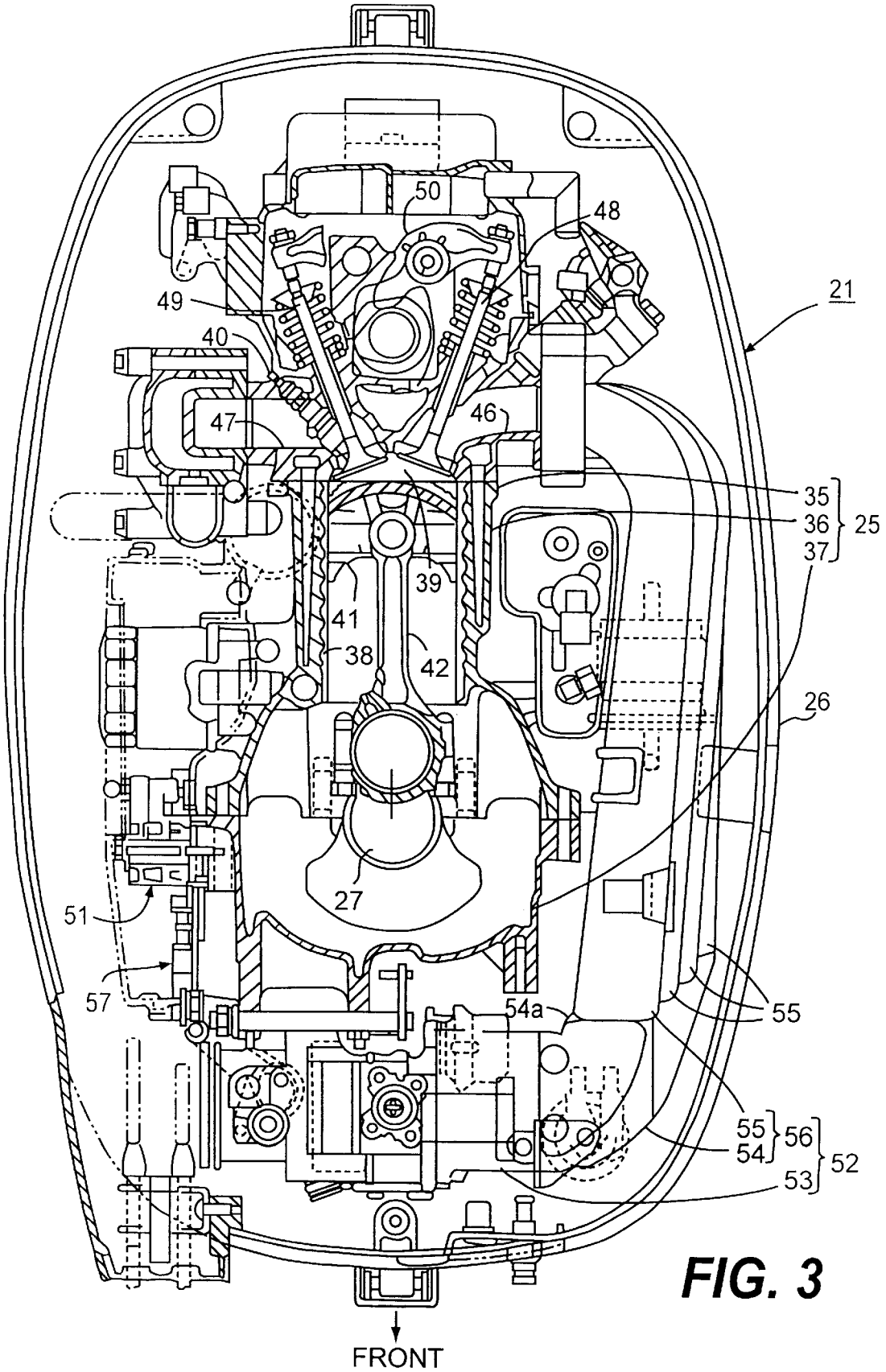
FIG. 3 is a cross section on line III—III of FIG. 2.
Figure 4:
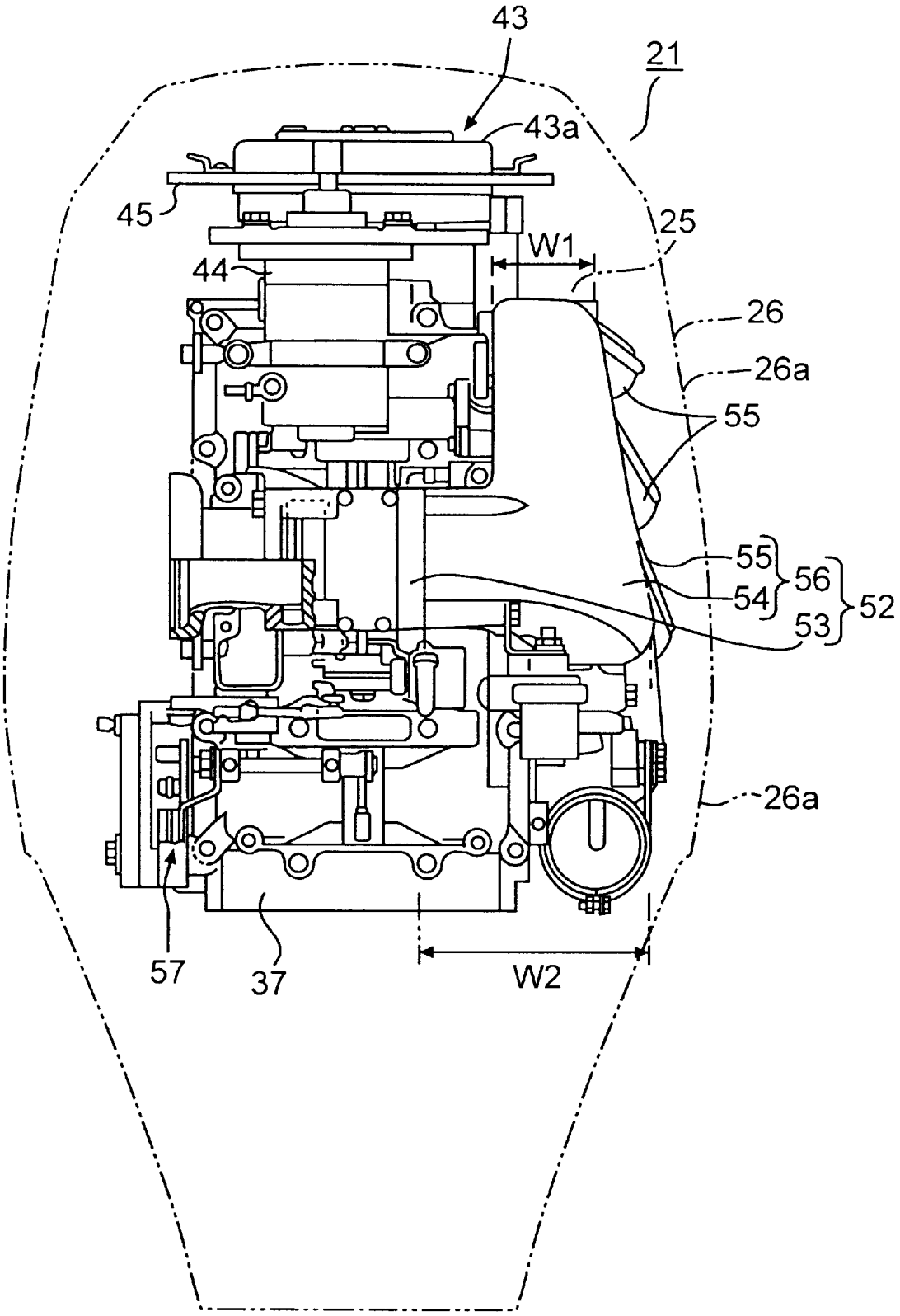
FIG. 4 is a front view seen from arrow IV of FIG. 2.
Figure 5:
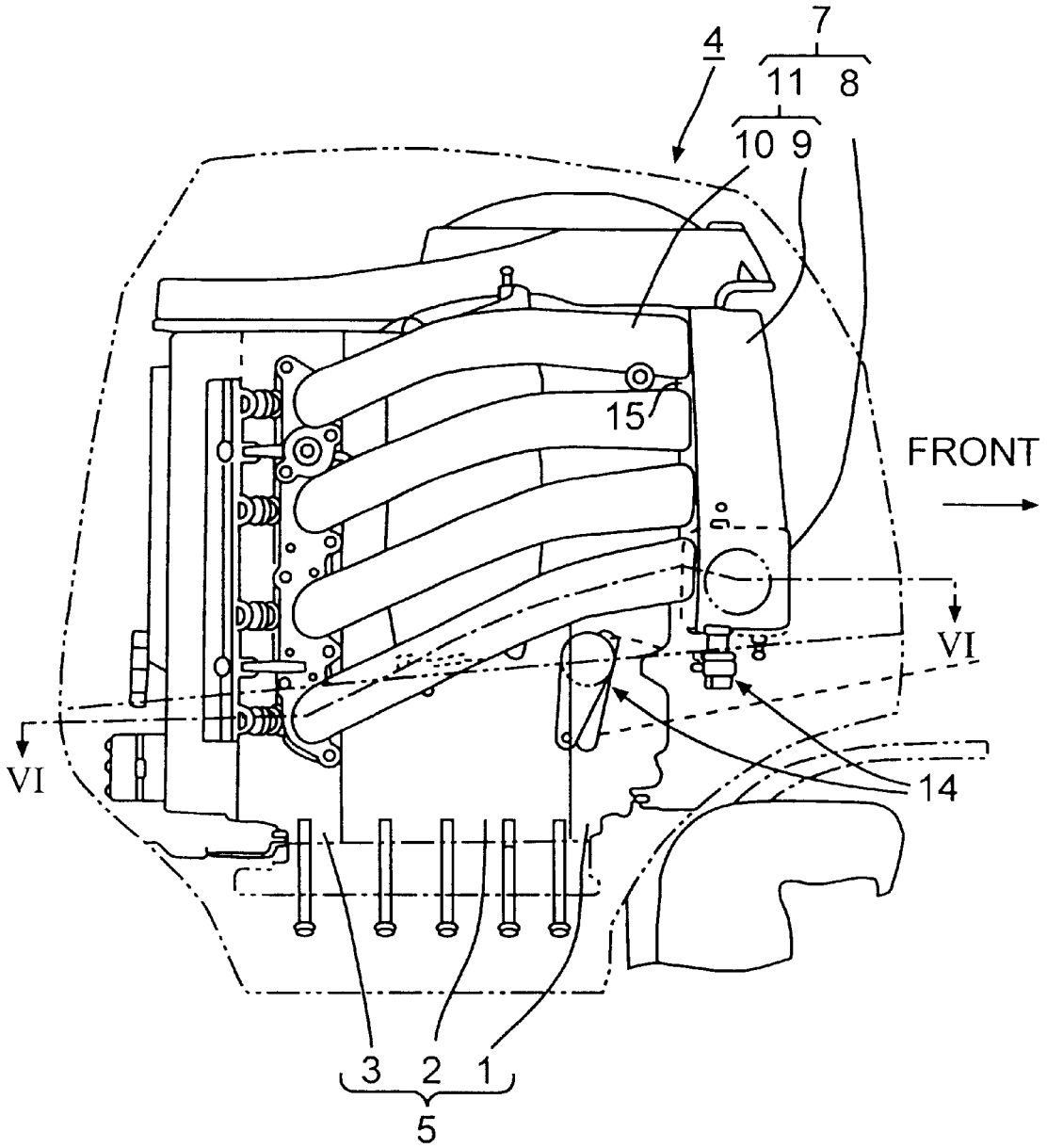
FIG. 5 is a right side view of the engine in a conventional outboard motor.
Figure 6:
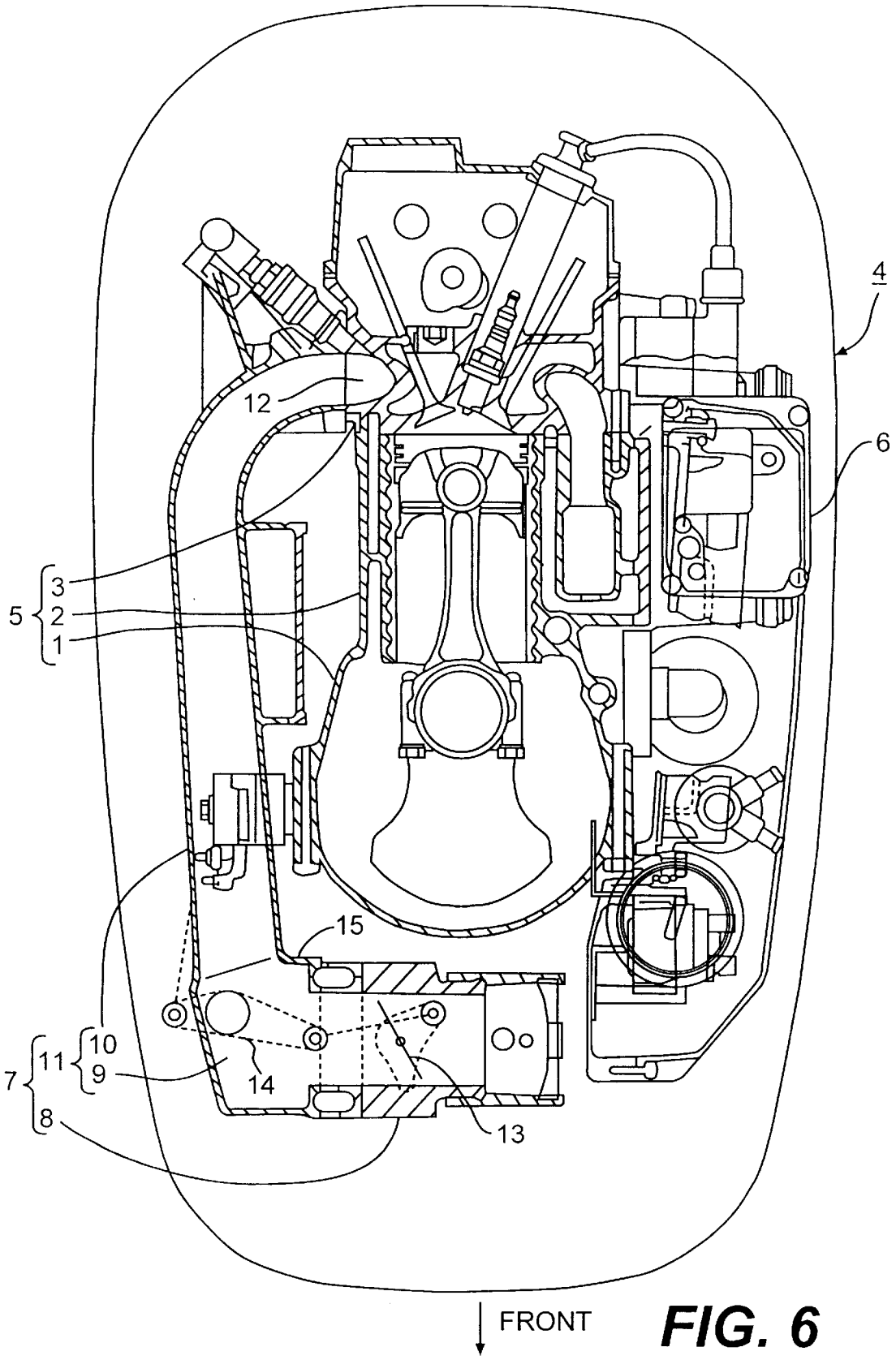
FIG. 6 is a cross section on line VI—VI of FIG. 5.

The air intake pipes (55) are connected to the surge tank on the rear surface (54*a*) of the surge tank. This surface (54*a*) is defined as a backward facing oblique plane, with its lower end further backward than its top end. The throttle body (53) is located between the center (55*a*) of the uppermost air intake pipe and the center (55*b*) of the lowermost air intake pipe. FIGS. 3 and 4 show the air intake pipes (55). The air intake pipes (55) are positioned so that they connect with the surge tank on an oblique line, progressively further away from the engine's cylinder block (36) as they are further down along the surge tank. At the same time, the surge tank (54) is formed to become progressively wider from upper with (W1) down to lower width (W2).

A throttle valve (not shown in the figures) is located in the throttle body to adjust the amount of air intake. Through link mechanism (57), the throttle valve can be operated remotely. Link mechanism (57) is disposed on the side of the engine opposite to the air intake manifold (56).

The side of the engine opposite from the air intake manifold (56) is very uncluttered, because the pipes of the air intake system are located on the opposite side, together with the intake manifold. The linkage mechanism (57) to operate the throttle valve is located in this uncluttered area, so that it is easy to assemble and maintain.

The rear surface (54*a*) of the elongated, vertical surge tank forms the interface between the air intake pipes (55) and the surge tank (54). The rear surface (54*a*) is shaped like an oblique plane, with the bottom end placed further backward than the top end. By taking advantage of the shape of the surge tank, the air intake pipes (55) that extend into each of the cylinders can be formed from pipes of approximately equal length. This design reduces the cost and complexity of molds used to cast the air intake pipes (55).

This configuration also lets the air intake pipes have a simpler shape, which reduces pathway resistance to the air taken in, and improves engine performance. Forming the rear surface (54*a*) of the surge tank on an oblique plane also results in smoother air flow reaching the engine, which performs better. The-surge tank (54) can be made more compact, while achieving an increased internal volume. The surge tank and the air intake device (52) can be easily placed below the ring gear (45), so that the entire outboard motor (21) can be made more compact.

Improved engine performance is also obtained by locating the center (53*a*) of the throttle body between the center (55*a*) of the uppermost air intake pipe and the center (55*b*) of the lowermost air intake pipe. In this manner, the air taken in by the cylinders from the surge tank (54) is better distributed to each of the combustion chambers.

As shown in FIG. 4, the upper cover portion (26*a*) of the engine cover (26) generally faces downward when seen from the front of the engine, and can be opened upward. Since the air intake pipes (55) are placed farther from the cylinder block (36), more space is available for use between the cylinder block and the air intake pipes (55), particularly towards the bottom of the air intake pipes stack. Additionally, the air intake manifold (56) follows the inner contour of the upper cover (26*a*), so that a large space is available between the air intake pipes (55) and the engine (25). Other components can be located in this space without expanding the outer boundary of the cover (21).

The width of the surge tank gradually increases from the top width (W1) to the bottom width (W2), so that the surge tank's volume capacity can be increased while simultaneously rendering the engine more compact.

The outboard motor air intake device of the present invention has a throttle body located approximately horizontally in front of the engine, a surge tank located on a side of the throttle body, and an air intake manifold with multiple air intake pipes that extend on one side of the engine from the surge tank to each of the cylinders. A throttle valve is located in the throttle body, and a linkage mechanism to operate the throttle valve is located on the side opposite from the air intake manifold. The linkage mechanism can be easily assembled and maintained.

A ring gear operationally connected to a starter motor is located in the upper part of the engine. The air intake device is located below the ring gear, and the air intake pipes are arranged in a stack, one above another, on one side of the engine. The throttle body is located between the centers of the upper and lower air intake pipes, so that the engine can be made compact, and an improved distribution of air from the surge tank to the engine combustion chambers can be obtained.

The rear surface of the surge tank to which are joined the air intake pipes is formed along an oblique plane, so that the bottom end is further backward than the top end. The air intake pipes have a simpler configuration requiring the use of less expensive molds when forging the air intake pipes, and at the same time provides a smoother flow path for the air taken in through the pipes.

A large space is available between the air intake pipes and the engine block, since the pipes are placed progressively further away from the engine as they are attached at lower positions along the length of the surge tank. The surge tank has a progressively increasing width from its top to its bottom so that its internal volume capacity is increased while reducing the overall size of the engine.

It will be apparent to those skilled in the art that various modifications and variations can be made in the structure of the present invention without departing from the spirit or scope of the invention. Thus, it is intended that the present invention cover the modifications and variations of this invention provided they come within the scope of the appended claims and their equivalents.

What is claimed is:

1. An outboard motor air intake device comprising:

a throttle body located substantially horizontally adjacent a front surface of an engine;

a surge tank attached to the throttle body located adjacent a first side surface of the engine;

an air intake manifold located adjacent the first side surface and comprising multiple air intake pipes each extending from the surge tank to a corresponding cylinder;

a throttle valve located in the throttle body; and a linkage mechanism to operate the throttle valve, located adjacent to a second side surface opposite the first side surface of the engine.

2. An outboard motor air intake device comprising:

a throttle body located substantially horizontally adjacent a front surface of an engine;

a surge tank located adjacent a first side of the engine;

an air intake manifold located adjacent the first side and comprising multiple air intake pipes each extending from the surge tank to a corresponding cylinder;

a throttle valve located in the throttle body; and a linkage mechanism to operate the throttle valve, located on a second side opposite the first side of the engine, wherein a ring gear operationally connected to a starting motor is located on a top portion of the engine, and wherein the air intake device is located below the ring gear; said air intake pipes being stacked one above the other from top to bottom on one side of the engine; and said throttle body being disposed between the midpoints of uppermost and lowermost air intake pipes.

3. An outboard motor air intake device comprising:

a throttle body located substantially horizontally adjacent a front surface of an engine;

a surge tank located adjacent a first side of the engine;

an air intake manifold located adjacent the first side and comprising multiple air intake pipes each extending from the surge tank to a corresponding cylinder;

a throttle valve located in the throttle body; and a linkage mechanism to operate the throttle valve, located on a second side opposite the first side of the engine, wherein the air intake pipes attach to a rear surface of the surge tank, that is formed on an oblique plane so that the bottom end of the rear surface is further backwards than the top end of the rear surface.

4. The outboard motor air intake device of claim 2, wherein the air intake pipes are arranged so that they are farther removed from the engine the farther downward they are positioned.

5. An outboard motor air intake device comprising:

a throttle body located substantially horizontally adjacent a front surface of an engine;

a surge tank located adjacent a first side of the engine;

an air intake manifold located adjacent the first side and comprising multiple air intake pipes each extending from the surge tank to a corresponding cylinder;

a throttle valve located in the throttle body; and a linkage mechanism to operate the throttle valve, located on a second side opposite the first side of the engine, wherein the width of the surge tank gradually increases from an upper width to a lower width.

* * * * *